US006712015B1

(12) United States Patent
Chen

(10) Patent No.: US 6,712,015 B1
(45) Date of Patent: Mar. 30, 2004

(54) OBLIQUE THREAD-GUIDING LINK OF A SEWING MACHINE

(75) Inventor: Shih-Fang Chen, Taipei (TW)

(73) Assignee: Ching Chi Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/424,916

(22) Filed: Apr. 29, 2003

(51) Int. Cl.[7] ..... D05B 49/02; D05B 55/14; D05B 69/32

(52) U.S. Cl. ..... 112/302; 112/284; 112/220

(58) Field of Search ..... 112/302, 254, 112/220, 284, 281, 259, 163, 165, 241, 242

(56) References Cited

U.S. PATENT DOCUMENTS 1,999,893 A * 4/1935 Christensen ..... 112/2
2,048,555 A * 7/1936 Lindstom ..... 112/258
2,905,120 A * 9/1959 Hacklander ..... 112/320
4,875,422 A * 10/1989 Ishikawa ..... 112/258
5,899,156 A * 5/1999 Schopf et al. ..... 112/241

* cited by examiner

*Primary Examiner*—Ismael Izaguirre
(74) *Attorney, Agent, or Firm*—Rosenberg, Klein & Lee

(57) ABSTRACT

An oblique thread-guiding link of a sewing machine, including a swing arm having a front swing arm and a rear swing arm and formed with a central shaft hole. A pivot shaft is fixedly fitted in the shaft hole of the swing arm. Two ends of the pivot shaft are obliquely pivotally mounted in two opposite sidewalls of the housing of the sewing machine. One end of the pivot shaft protrudes from the housing of the sewing machine. The front end of the front swing arm is positioned above a needle holder mechanism and aligned and coupled therewith. The rear end of the rear swing arm is positioned above a driving mechanism and aligned and coupled therewith. One end of a thread-guiding fixing seat is fixedly connected with the protruding end of the pivot shaft and can be swung along with the swing arm.

4 Claims, 5 Drawing Sheets

OBLIQUE THREAD-GUIDING LINK OF A SEWING MACHINE

BACKGROUND OF THE INVENTION

1. Field of the Invention

The present invention is related to an oblique thread-guiding link of a sewing machine, in which the swing arm is obliquely mounted in the sewing machine.

2. Description of the Prior Art

FIGS. 1 and 2 show a conventional sewing machine. A swing arm 91 is pivotally mounted in the sewing machine. The center of the swing arm 91 has a sleeve 911 having a shaft hole 912. A pivot shaft 92 is axially fitted through the shaft hole 912. Two ends of the pivot shaft 92 are perpendicularly pivotally mounted between two sidewalls 93*a*, 93*b* of the sewing machine. A front swing arm 91*a* forward radially projects from a first side of the sleeve 911. A rear swing arm 91*b* rearward radially projects from a second side of the sleeve 911. The front swing arm 91*a* is positioned above a needle holder mechanism 94 and aligned and coupled therewith. The rear end of the rear swing arm 91*b* is positioned above a driving mechanism 95 and coupled therewith. When the driving mechanism 95 up and down drives the rear swing arm 91*b*, the front swing arm 91*a* is swung along with the rear swing arm 91*b* to drive the needle holder mechanism 94 to move up and down. At the same time, a thread guiding rod 96 mounted on outer side of the pivot shaft 92 is driven and swung to guide the stitch thread into the needle holder mechanism 94.

Referring to FIGS. 1 and 2, the front and rear swing arms 91*a*, 91*b* of the swing arm 91 are respectively positioned on left and right sides of the sleeve 911. Therefore, the central axis 9*a* of the front swing arm 91*a* does not coincide with the central axis 9*b* of the rear swing arm 91*b*. Instead, the axis 9*a* is spaced from the axis 91*b* by a distance D. Therefore, when the driving mechanism 95 drives the swing arm 91 to swing up and down about the pivot shaft 92, the action force F will create a bending moment M onto the swing arm 91. As a result, when the swing arm 91 quickly up and down swing, the swing arm 91 is vibrated to emit a noise. This tends to speed the wearing the pivot shaft.

SUMMARY OF THE INVENTION

It is therefore a primary object of the present invention to provide an oblique thread-guiding link of a sewing machine, including a swing arm having a front section defined as a front swing arm and a rear section defined as a rear swing arm. The center of the swing arm is formed with a shaft hole in which a pivot shaft is tightly fitted. Two ends of the pivot shaft are obliquely pivotally mounted in two opposite sidewalls of the housing of the sewing machine. One end of the pivot shaft protrudes from the housing of the sewing machine. The front end of the front swing arm is positioned above a needle holder mechanism and aligned and coupled therewith. The rear end of the rear swing arm is positioned above a driving mechanism and aligned and coupled therewith. One end of a thread-guiding fixing seat is fixedly connected with the protruding end of the pivot shaft and is driven by the swing arm to swing. A thread-guiding bar is fixed at the second end of the thread-guiding fixing seat and formed with multiple thread-guiding eyelets.

It is a further object of the present invention to provide the above oblique thread-guiding link of the sewing machine, in which the front and rear ends of the swing arm are straightly projectively positioned above the needle holder mechanism and the driving mechanism to correspondingly couple therewith. The application force point and the resistance force point are positioned on the same straight line so as to eliminate the vibration and noise produced when the swing arm swings.

It is still a further object of the present invention to provide the above oblique thread-guiding link of the sewing machine, in which two collars are respectively fitted on two ends of the pivot shaft. The bodies of the collars are inlaid in the sidewalls of the sewing machine. One end of the body of each collar is formed with a flange for abutting against inner side of the sidewall of the sewing machine. Accordingly, the pivot shaft can stably swing in a predetermined position without axially sliding.

The present invention can be best understood through the following description and accompanying drawings wherein:

DETAILED DESCRIPTION OF THE PREFERRED EMBODIMENT

Figure 1:
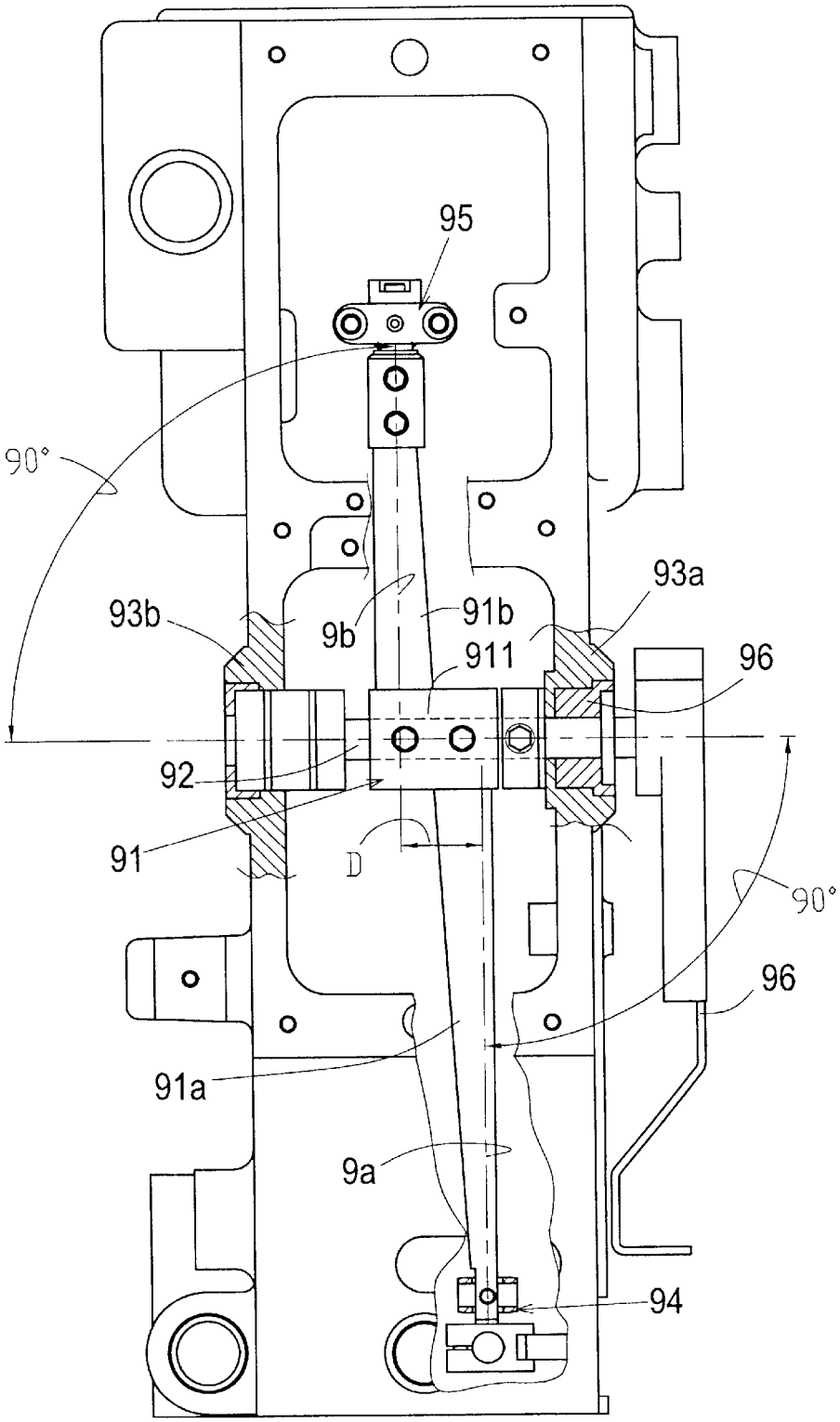
Fig. 1 PRIOR ART
FIG. 1 is a view of the structure of a conventional sewing machine.
Figure 2:
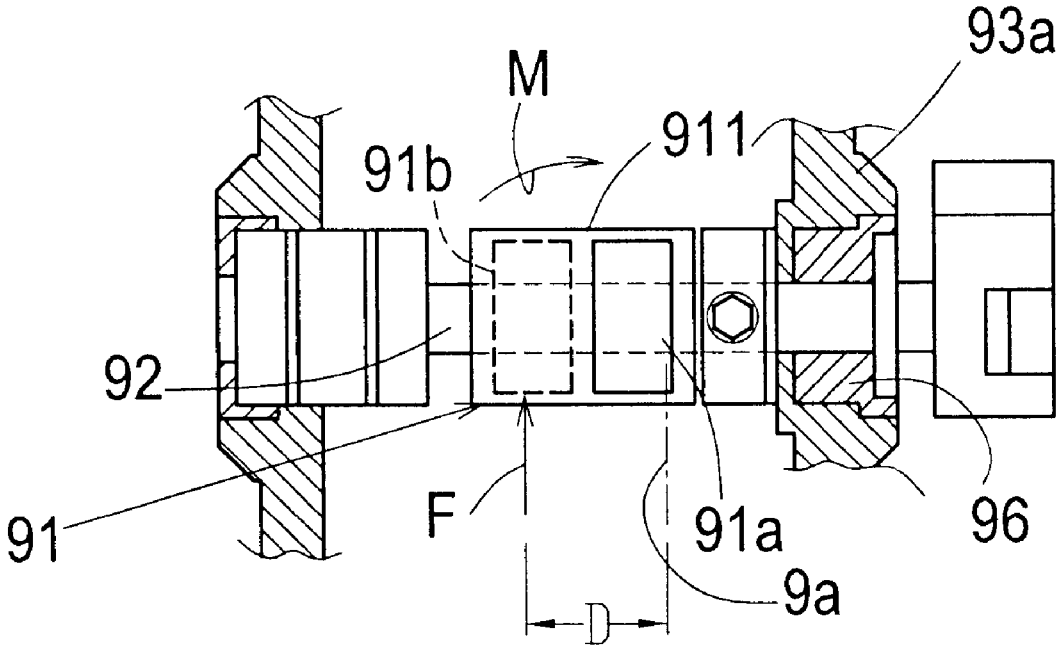
Fig. 2 PRIOR ART
FIG. 2 is a view showing the operation of the swing arm of the conventional sewing machine.
Figure 3:
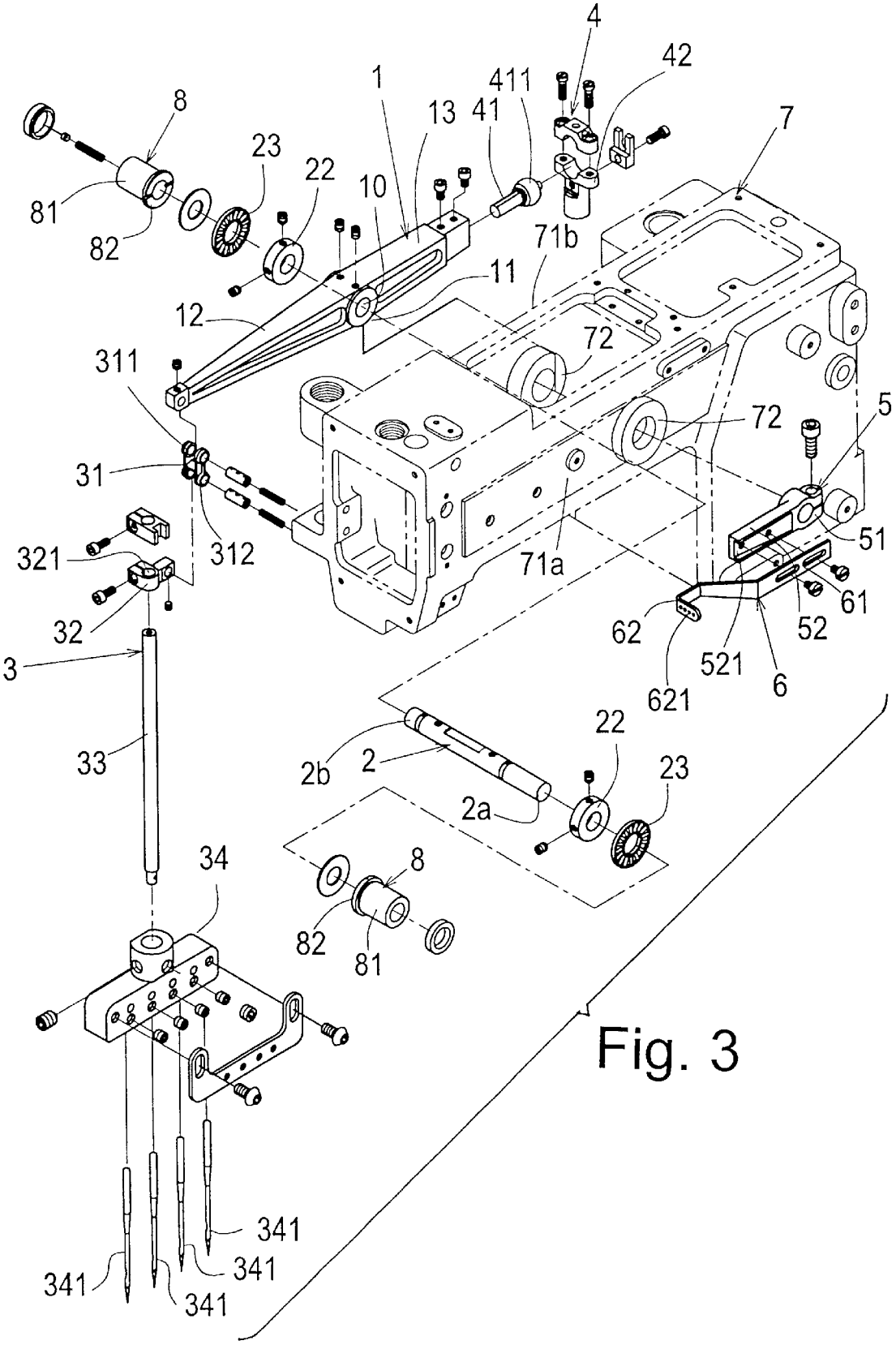
FIG. 3 is a perspective exploded view of the present invention.
Figure 4:
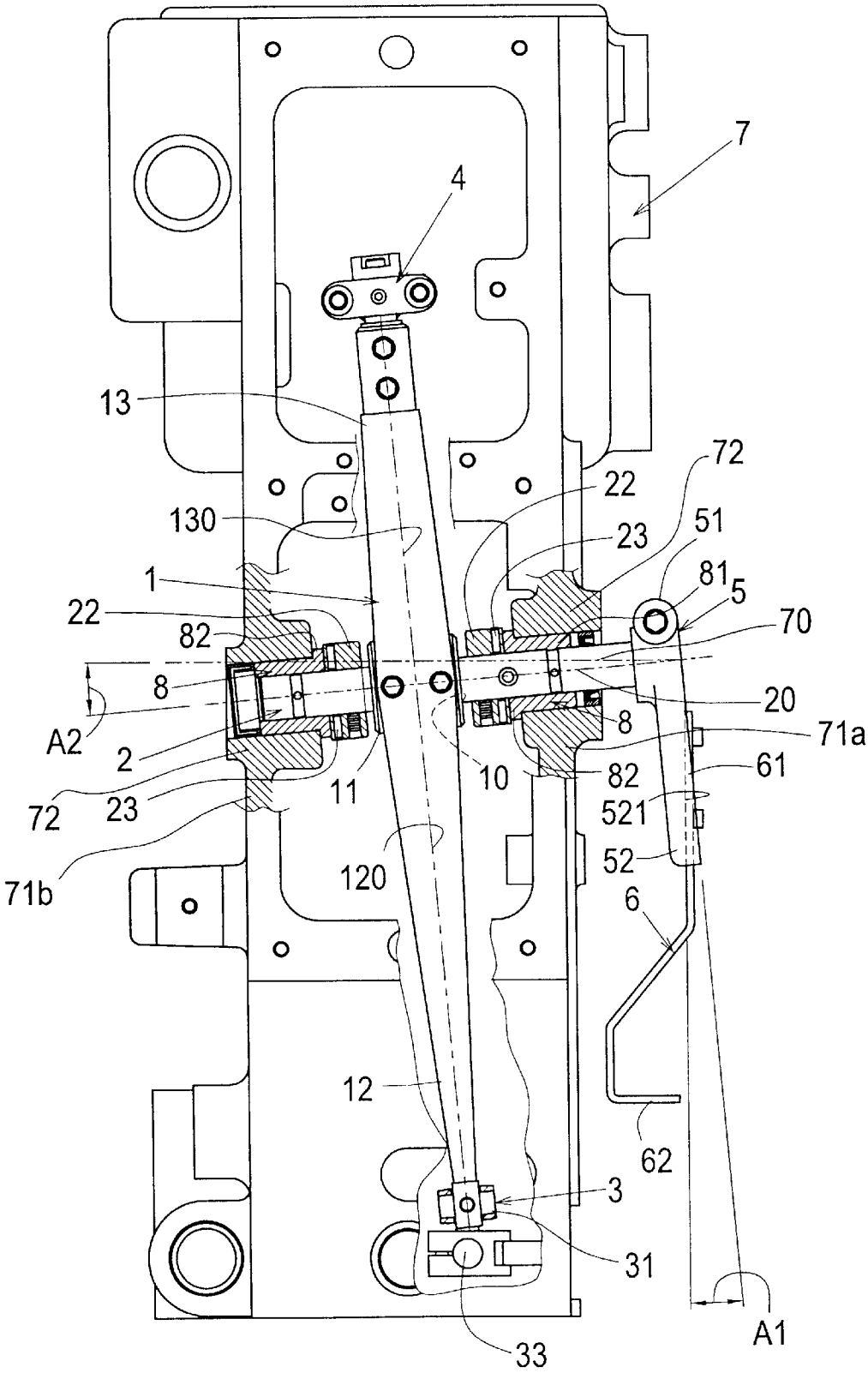
FIG. 4 is a top view showing the structure of the present invention.
Figure 5:
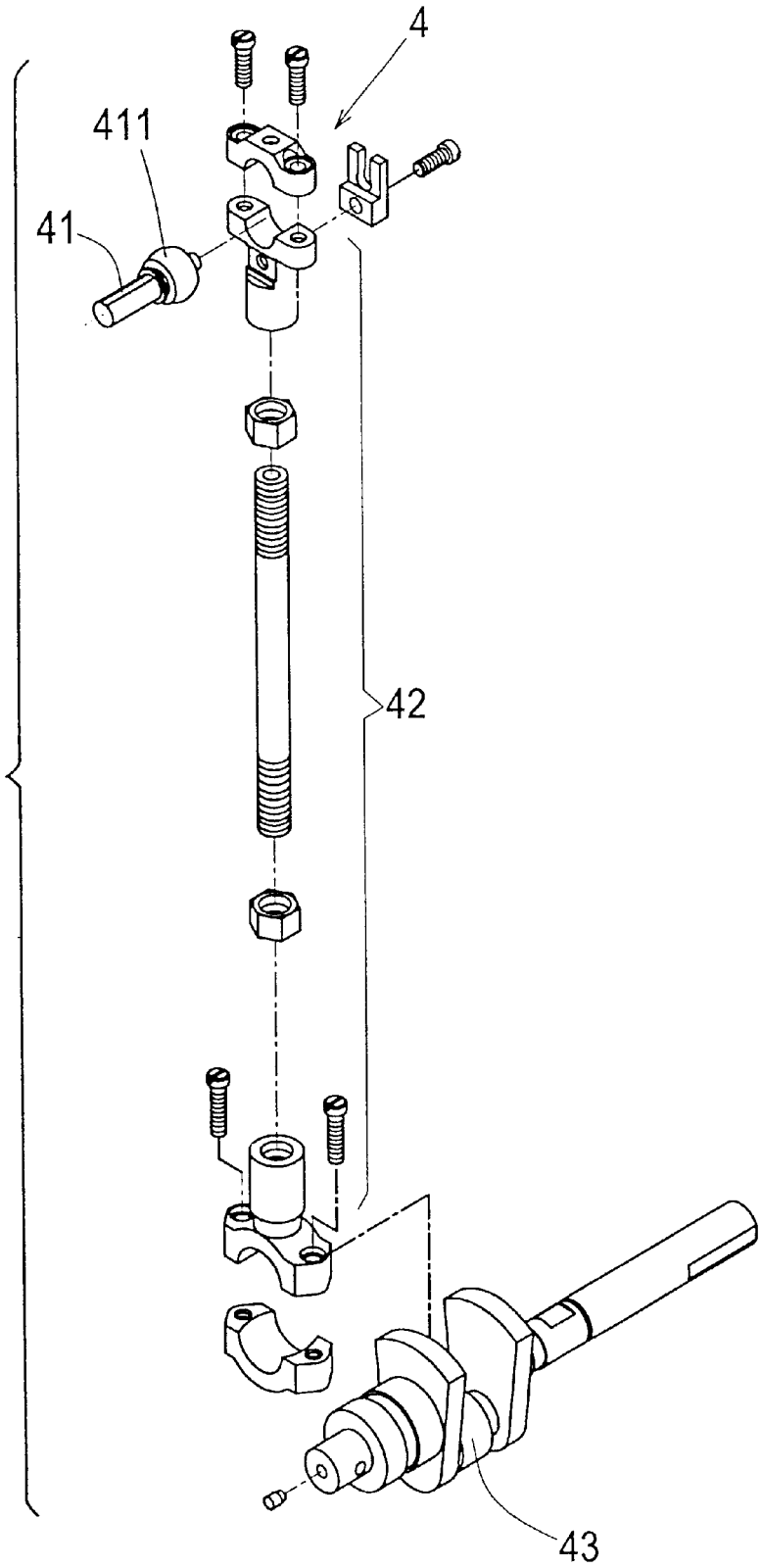
FIG. 5 is a perspective exploded view of the driving mechanism of the present invention.

Please refer to FIGS. 3 to 5. The oblique thread-guiding link of the sewing machine of the present invention includes: a swing arm 1; a pivot shaft 2 snugly tightly fitted in the swing arm 1, two ends 2*a*, 2*b* of the pivot shaft 2 being obliquely pivotally mounted between two opposite sidewalls 71*a*, 71*b* of the sewing machine 7; a needle holder mechanism 3 drivingly coupled with front end of the swing arm 1; a driving mechanism 4 coupled with rear end of the swing arm 1; a thread-guiding fixing seat 5 fixedly connected with one end 2*a* of the pivot shaft 2, the thread-guiding fixing seat 5 being drivable by the pivot shaft 2 to swing; and a thread-guiding bar 6, a first section 61 of the thread-guiding bar 6 being tightly fixed on the thread-guiding fixing seat 5, a second section 62 of the thread-guiding bar 6 being formed with multiple thread-guiding eyelets 621 for guiding the thread into the needle holder mechanism 3. The front and rear ends of the swing arm 1 are straightly projectively positioned above the needle holder mechanism 3 and the driving mechanism 4 and correspondingly coupled therewith. The application force point and the resistance force point are positioned on the same straight line so as to eliminate the vibration and noise produced when the swing arm 1 swings.

Referring to FIGS. 3 and 4, the swing arm 1 of the present invention is integrally formed. The swing arm 1 has a sleeve section 11 formed with a central axial shaft hole 10. The pivot shaft 2 is snugly fitted in the shaft hole 10. A front swing arm 12 forward radially projects from the middle of outer circumference of the sleeve section 11. In addition, a rear swing arm 13 rearward radially projects from the middle of outer circumference of the sleeve section 11. The central axis 120 of the front swing arm 12 coincides with the central axis 130 of the rear swing arm 13. The front end of the front swing arm 12 is positioned above a needle holder mechanism 3 and aligned and coupled therewith. The rear end of the rear swing arm 13 is positioned above a driving mechanism 4 and aligned and coupled therewith.

Two ends 2*a*, 2*b* of the pivot shaft 2 are obliquely pivotally mounted in two shaft seats 72 of two opposite sidewalls 71*a*, 71*b* of the sewing machine 7. One end 2*a* of the pivot shaft 2 protrudes from one sidewall 71*a* of the sewing machine 7 for connecting with the thread-guiding fixing seat 5.

Two retainer rings 22 are locked on the pivot shaft 2 on two sides of the swing arm 1. Two axial thrust bearings 23 are fitted on the pivot shaft 2 between the outer sides of the retainer rings 22 and the shaft seats 72 of the sewing machine 7, whereby the swing arm 1 can more smoothly swing.

The needle holder mechanism 3 includes a coupling member 31 having a first coupling section 311 coupled with the front end of the front swing arm 12 of the swing arm 1. The needle holder mechanism 3 further includes a link seat 32 pivotally connected with a second coupling section 312 of the coupling member 31. The link seat 32 is formed with a fitting through hole 321. The needle holder mechanism 3 further includes a connecting rod 33 fitted in the fitting hole 321 of the link seat 32. The needle holder mechanism 3 further includes a needle holder 34 tightly fixed at bottom end of the connecting rod 33. Multiple needles 341 are locked on the needle holder 34.

Referring to FIGS. 3 and 5, the driving mechanism 4 includes a ball joint 41 connected with rear end of the rear swing arm 13 and a link 42. The spherical head section 411 of the ball joint 41 is snugly fitted in a first end of the link 42. A second end of the link 42 stably rides on a transmission cam 43. When the transmission cam 43 is driven and rotated by a motor (not shown), the link 42 is moved up and down to drive the swing arm 1 to swing up and down.

A first end of the thread-guiding fixing seat 5 is tightly fixedly connected with a section of the pivot shaft 2 protruding from the housing of the sewing machine. A second end 52 of the thread-guiding fixing seat 5 is driven by the pivot shaft 2 to swing up and down. The end face of the second end of the thread-guiding fixing seat 5 is formed with a connecting face 521. The connecting face 521 and a line normal to the axis 20 of the pivot shaft 2 contain an angle A1. The axis 20 of the pivot shaft 2 and a horizontal line 70 normal to the sidewalls 71*a*, 71*b* of the sewing machine 7 contain an angle A2. The angle A1 is equal to the angle A2. That is, when the first end 51 of the thread-guiding fixing seat 5 is fixedly mounted on the pivot shaft 2, the connecting face 521 is parallel to the sidewall 71*a* of the sewing machine.

The first section 61 of the thread-guiding bar 6 is fixed on the connecting face 521 of the second end of the thread-guiding fixing seat 5, whereby the thread-guiding bar 6 can be up and down swung along with the thread-guiding fixing seat 5. The second section 62 of the thread-guiding bar 6 is formed with multiple thread-guiding eyelets 621 for guiding multiple threads into the needle holder mechanism 3.

The needle holder mechanism 3 and the driving mechanism 5 pertain to prior art and are not included in the scope of the present invention. The present invention is characterized in that the pivot shaft 2 fitted in the swing arm 1 is obliquely pivotally mounted between the two opposite sidewalls of the sewing machine 7. The central axes 120, 130 of the front and rear swing arms 12, 13 coincide with each other. The front end of the front swing arm 12 is positioned above a needle holder mechanism 3 and aligned and coupled therewith. The rear end of the rear swing arm 13 is positioned above a driving mechanism 4 and coupled therewith. By means of the obliquely arranged swing arm, the problems of vibration and noise produced when the conventional sewing machine operates by reason that the axes of the front and rear swing arms do not coincide with each other can be eliminated.

In addition, two collars 8 are respectively fitted on two ends of the pivot shaft 2. The bodies 81 of the collars 8 are inlaid in the sidewalls 71*a*, 71*b* of the sewing machine 7. One end of the body 81 of each collar 8 is formed with a flange 82 for abutting against inner side of the sidewall 71*a*, 71*b* of the sewing machine 7. Accordingly, the pivot shaft 2 can stably swing in a predetermined position without axially sliding.

The oblique thread-guiding link of the sewing machine of the present invention has the following advantages:

1. The front and rear ends of the swing arm 1 are straightly projectively positioned above the needle holder mechanism 3 and the driving mechanism 4 to correspondingly couple therewith. The application force point and the resistance force point are positioned on the same straight line so as to eliminate the vibration and noise produced when the swing arm 1 swings.
2. Two collars 8 are respectively fitted on two ends of the pivot shaft 2. The bodies 81 of the collars 8 are inlaid in the sidewalls 71*a*, 71*b* of the sewing machine 7. One end of the body 81 of each collar 8 is formed with a flange 82 for abutting against inner side of the sidewall 71*a*, 71*b* of the sewing machine 7. Accordingly, the pivot shaft 2 can stably swing in a predetermined position without axially sliding.

The above embodiment is only used to illustrate the present invention, not intended to limit the scope thereof. Many modifications of the above embodiment can be made without departing from the spirit of the present invention.

What is claimed is:

1. An oblique thread-guiding link of a sewing machine, comprising:

(a) a swing arm having a sleeve section formed with a central axial shaft hole, a pivot shaft being snugly tightly fitted in the shaft hole, a front swing arm forward radially projecting from the middle of outer circumference of the sleeve section, a rear swing arm rearward radially projecting from the middle of outer circumference of the sleeve section, (b) a needle holder mechanism coupled with a front end of the front swing arm;

(c) a driving mechanism coupled with a rear end of the rear swing arm;

(d) a thread-guiding fixing seat, a first end of the thread-guiding fixing seat being fixedly connected with one end of the pivot shaft; and (e) a thread-guiding bar fixedly mounted on the thread-guiding fixing seat and formed with multiple thread-guiding eyelets, said oblique thread-guiding link being characterized in that two ends of the pivot shaft fitted in the swing arm are obliquely pivotally mounted in two opposite sidewalls of the sewing machine, the central axes of the front and rear swing arms coinciding with each other, the front end of the front swing arm being positioned above the needle holder mechanism and aligned and coupled therewith, the rear end of the rear swing arm being positioned above the driving mechanism and aligned and coupled therewith.

2. The oblique thread-guiding link of the sewing machine as claimed in claim 1, wherein two retainer rings are locked on the pivot shaft on two sides of the swing arm, two axial thrust bearings being fitted on the pivot shaft on outer sides of the retainer rings.

3. The oblique thread-guiding link of the sewing machine as claimed in claim 1, wherein an end face of the second end of the thread-guiding fixing seat is formed with a connecting face, the connecting face and a line normal to the axis of the pivot shaft containing a first angle, the axis of the pivot shaft and a horizontal line normal to the sidewalls of the sewing machine containing a second angle, the first angle being equal to the second angle, whereby when the first end of the thread-guiding fixing seat is fixedly mounted on the pivot shaft, the connecting face is parallel to the sidewalls of the sewing machine.

4. The oblique thread-guiding link of the sewing machine as claimed in claim 1, wherein two collars are respectively fitted on two ends of the pivot shaft, the bodies of the collars being inlaid in the sidewalls of the sewing machine, one end of the body of each collar being formed with a flange for abutting against inner side of the sidewall of the sewing machine.

* * * * *